US007365699B2

(12) United States Patent
Grebel et al.

(10) Patent No.: US 7,365,699 B2
(45) Date of Patent: Apr. 29, 2008

(54) INDEPENDENTLY CENTER FED DIPOLE ARRAY

(75) Inventors: Haim Grebel, Livingston, NJ (US); Nan Ni, Beijing (CN)

(73) Assignee: New Jersey Institute of Technology, Newark, NJ (US)

( * ) Notice: Subject to any disclaimer, the term of this patent is extended or adjusted under 35 U.S.C. 154(b) by 0 days.

(21) Appl. No.: 11/130,839

(22) Filed: May 17, 2005

(65) Prior Publication Data

US 2005/0259027 A1 Nov. 24, 2005

Related U.S. Application Data

(60) Provisional application No. 60/572,355, filed on May 19, 2004.

(51) Int. Cl.
*H01Q 21/00* (2006.01)
*H01Q 9/16* (2006.01)

(52) U.S. Cl. ..... 343/810; 343/729.5; 343/793

(58) Field of Classification Search ..... 343/810, 343/792.5, 793
See application file for complete search history.

(56) References Cited

U.S. PATENT DOCUMENTS 5,742,583 A * 4/1998 Scott ..... 370/342
5,940,044 A * 8/1999 Smith ..... 343/810
6,346,921 B1 * 2/2002 Excell et al. ..... 343/792.5
6,473,054 B1 * 10/2002 Lopez et al. ..... 343/820
6,531,985 B1 * 3/2003 Jones et al. ..... 343/702
6,809,694 B2 * 10/2004 Webb et al. ..... 343/754
6,859,175 B2 * 2/2005 Desclos et al. ..... 343/700 MS
2002/0084934 A1 * 7/2002 Vail et al. ..... 342/372
2004/0014503 A1 * 1/2004 Lobinger et al. ..... 455/562.1
2005/0206563 A1 * 9/2005 Guy ..... 342/372
2005/0237266 A1 * 10/2005 Durham et al. ..... 343/909

OTHER PUBLICATIONS

J.P. Berenger, A perfectly matched layer for the absorption of electromagnetic waves, J. Computational Physics, vol. 114, pp. 185-200, 1994.
Watanabe, An improved FDTD model for the feeding gap of a thin-wire antenna, IEEE Microwave and Guided Wave Letters, Apr. 1998, 152-154, vol. 8, No. 4.
P.S. Excell et al., An independently-fed log-periodic antenna for directed pulsed radiation, National Conference on Antennas and Propogation: Mar. 30-Apr. 1, 1999, p. 234-236, Conference Publication No. 461.
K.R. Umashankar et al., Calculation and experimental validation of induced currents on coupled wires in an arbitrary shaped cavity, IEEE Trans. Antennas Propagat, vol. AP-35, pp. 1248-1257, Nov. 1987.

(Continued)

*Primary Examiner*—Trinh Vo Dinh
(74) *Attorney, Agent, or Firm*—Connolly Bove Lodge & Hutz LLP

(57) ABSTRACT

A dipole array is provided for use as an Ultra Short Pulse (USP) transmitter or receiver in UWB communications systems, which reduces the output pulse dispersion. Instead of having all the dipole elements serially fed by a transmission line, the feeding in the array is made independently through a central point and the radiation is emitted and received broadsided with respect to the array plane. This configuration minimizes the relative time delay between radiating resonance frequencies.

13 Claims, 6 Drawing Sheets

OTHER PUBLICATIONS

Guofeng Lu et al., Diamond and rounded Diamond Antennas for Ultrawide-Band Communications, IEEE Antennas and Wireless Propagation Letters, 2004, vol. 3, pp. 249-252.
M. Hammond et al., Matching the input impedence of a broadband disc monopole, Electronics Letters, Feb. 18, 1993, vol. 29, No. 4.
O. Ramahi, Near- and Far-field calculations in FDTD Simulations using Kirchhoff Surface Integral Representation, IEEE Transactions on Antennas and Propagation, May 1997, vol. 45, No. 5, pp. 753-759.
R. Carrel, The Design of Log-Periodic Dipole Antennas, IRE International Convention Record, Mar. 1961, vol. 9, Part 1, pp. 61-75.
Shantz and Fullterton, The Diamond Dipole: A Gaussian Impulse Antenna, IEEE, 2001, pp. 100-103.
N.P. Agrawall, Wide-Band Planar Monopole Antennas, IEEE Transactions on Antennas and Propagation, Feb. 1998, vol. 46, No. 2, pp. 294-295.
T. Mitchell, Broad is the Way, IEE Review, Jan. 2001, vol. 47, pp. 35-39.
T. Hertel and G. Smith, On the dispersive properties of the conical spiral antenna and its use for pulsed radiation, IEEE Trans. Antennas Propagat., Jul. 2003, vol. 51, pp. 1426-1433.
J. Dabin et al., The effects of antenna directivity on path loss and multipath propagation in UWB Indoor Wireless Channels, in Proc. IEEE Ultra Wideband Systems and Technologies, 2003, pp. 305-309.
L. Fullerton, UWB waveforms and coding for communication and radar, Proc. Telesystems Conference, 1991, pp. 139-141.

* cited by examiner

INDEPENDENTLY CENTER FED DIPOLE ARRAY

RELATED APPLICATIONS

This application claims priority from U.S. Provisional patent Application Ser. No. 60/572,355 filed May 19, 2004.

FEDERALLY SPONSORED RESEARCH

Partial support for the present invention was provided by the National Science Foundation, and accordingly the U.S. Government may have certain license or other rights in the invention.

FIELD OF INVENTION

This invention relates to transmission and reception of ultra short pulses (USP) commonly used in ultra-wideband (UWB) communication systems, and more specifically relates to antenna arrays for use in such systems.

BACKGROUND OF INVENTION

The Ultra Wide-Band (UWB) technique, wherein the signal is defined as having greater than 25% relative bandwidth as determined by: $BW/f_c$, has been the subject of intense research efforts during the last several years because it presents a large bandwidth at short distance communication, which is desirable for many indoor wireless systems. See W. Stutzman and G. Thield, "Antenna theory and design," 2nd ed., John Wiley & Sons. New York, 1998. In order to implement a UWB technique, it is necessary to develop a relatively dispersionless antenna which maintains a good phase and amplitude linearity over a wide bandwidth transmitting and receiving ultra short pulses (USP). Among all the wide-band antennas, the log-periodic dipole array (LPDA) could provide the widest bandwidth. It is known that on the log-periodic antennas, each specific frequency has an active region which has a strong current excitation. As the frequency changes, such current excitation remains the same, but it moves locally toward the direction of the active region. Such a radiation mechanism would introduce a large time delay between the frequency constituent of the temporal pulse thus resulting in a severe dispersion to the short-pulsed UWB signal.

SUMMARY OF INVENTION

Now in accordance with the present invention a dipole array is provided which reduces the dispersion. Instead of having all the dipole elements serially fed by a transmission line, and instead of tuning each other element with an out-of-phase signal, the feeding in this array is made in parallel, through a central point such as a power divider. A transmission line is connected to the power divider for feeding the broadband signal to the power divider to ensure feeding with appropriate amplitude and phase correction into the dipole elements.

The configuration of the invention minimizes the relative time delay between radiating resonance frequencies since all frequency components of the pulse are transmitted or, received at the same time. This array also provides for a wide bandwidth since it enables placing of a sequence of parallel dipole elements of successively varied lengths with each additional dipole providing for an additional frequency band. The overall bandwidth of the array is constituted by the sum of the individual bandwidths of each dipole. Typically a broadband signal is split up by the power divider, and then fed into all the dipole elements in parallel. Thus, all frequency components of the signal will be simultaneously fed into and radiated out by the corresponding active elements. The radiation is emitted and received broadsided with respect to the array plane.

BRIEF DESCRIPTION OF DRAWINGS

In the drawings appended hereto:

FIG. 1(*b*) is the extension to 12 elements; and FIG. 1(*c*) shows the power divider for these elements;

DESCRIPTION OF PREFERRED EMBODIMENT

In the present invention, the new dipole array concept used is called an independently center-fed dipole array (ICDA). The feeding is made independently through a central point as seen in the schematic diagram of FIGS. 1(*a*) and 1(*c*), where FIG. 1(*c*) shows the use of a power divider fed by a transmission line, as previously discussed. Simulations, using Method of Moment (MoM) and Finite-Difference Time Domain (FDTD) and experiments with a two-element array exhibited the usefulness of this approach. Experimentally, the impact of mutual coupling on the SWR of each dipole was evaluate, and the transmission coefficient $S_{21}$, was also measured.

Figure 1A:
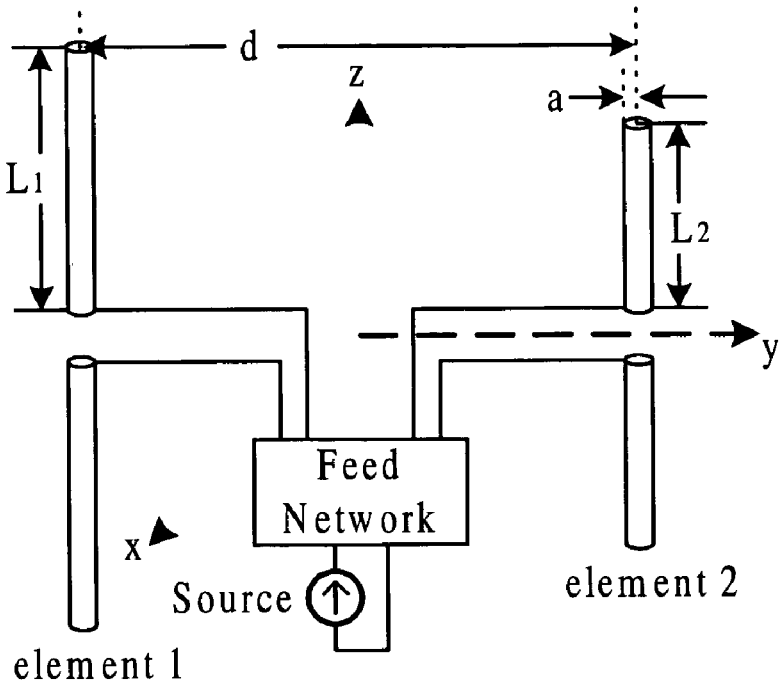
FIG. 1(*a*) is a schematic diagram of a ICDA array in accordance with the invention of two elements.
Figure 1B:
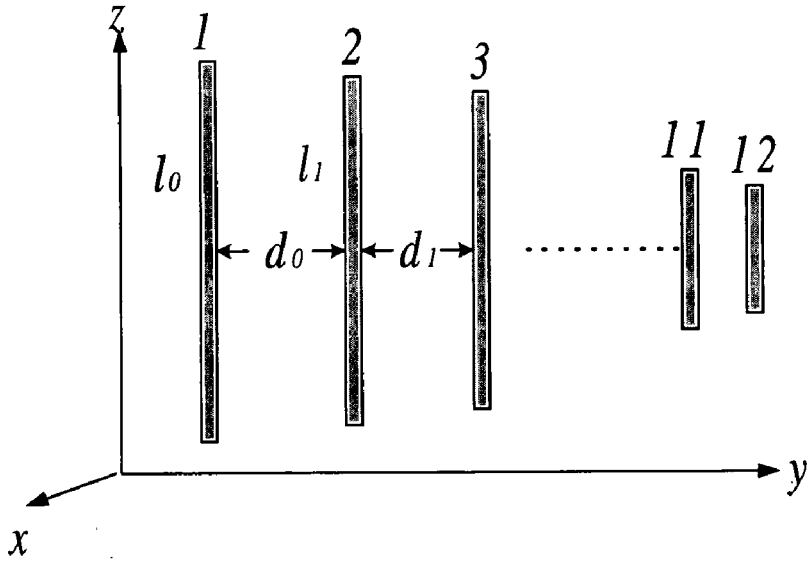
Figure 1C:
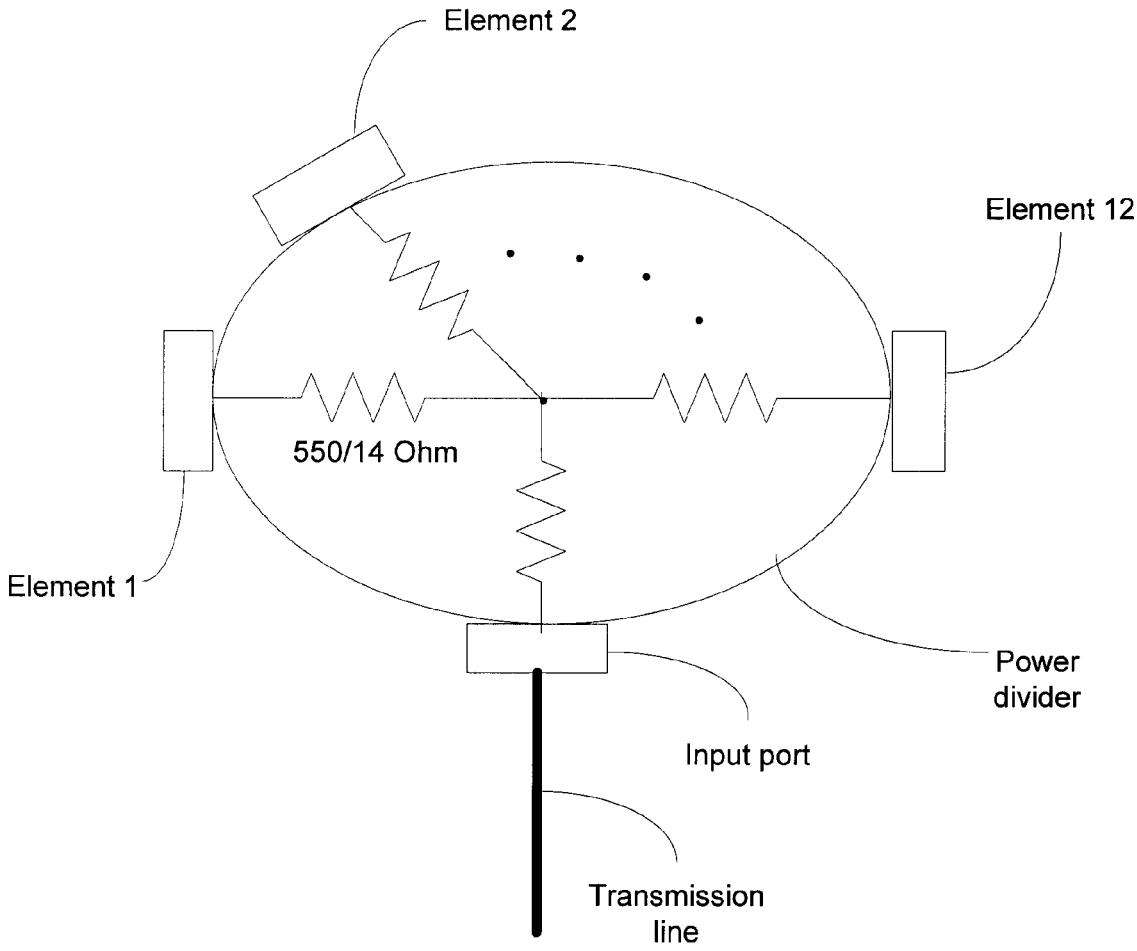
Figure 2:
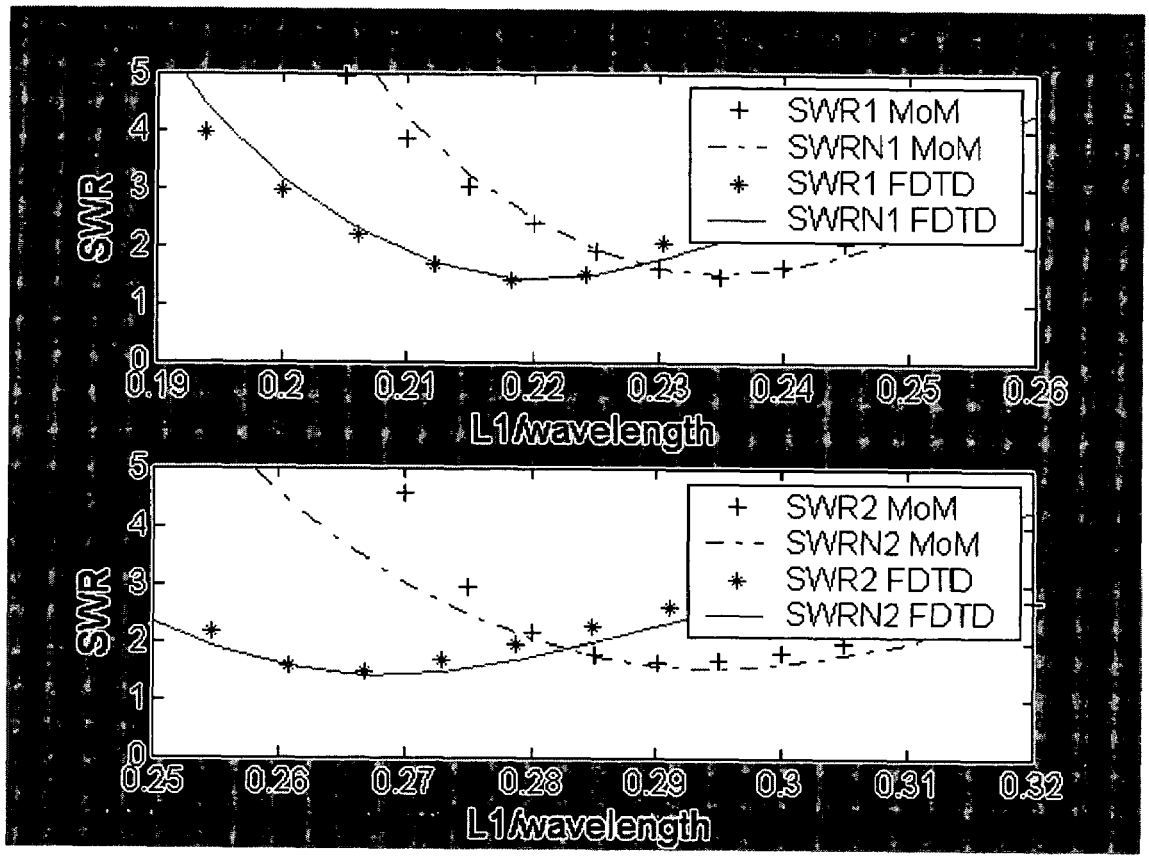
FIG. 2 contains graphs depicting variation of SWR of each element using Method of Moment (MoM) and Finite Difference Time Domain (FDTD)

Simulations: FIG. 1(*a*) shows the ICDA array in schematic form. The MoM and FDTD methods were used to calculate the SWR of each element, when the other is present or, absent. The codes used for the simulations were based on equations introduced in Stutzman, et al, Berenger, et al and Umashankar, et al, op. cit. In both simulations, we assume $L1=0.25$, $L2=L1\cdot 0.8=0.2$, $d=L1\cdot 0.6=0.15$, $a=2\cdot L1/150$ (see FIG. 1). The other FDTD parameters were: cell size, $\Delta=(2\cdot L1)/21$ and region of calculation (in terms of number of cells), 56×63×56. FIG. 2 shows the variation of the standing wave ratio, SWR, of each element. The terms SWR1 and SWRN1 are the SWR of element 1 when element 2 is present or, absent, respectively. Similarly, SWR2 and SWRN2 are the SWR of element 2 when element 1 is present or, absent, respectively. Thus, coupled elements exhibit similar SWR values as the isolated ones. FIGS. 1(*b*) and 1(*c*) also show the extension of this concept to twelve elements which cover the necessary 3.1-10.6 GHz bandwidth of UWB communication systems. The dipole array of the invention may comprise any linear set with a functional relationship between the separation of elements and their related lengths and thickness, such as occurs in but not limited to a log periodic array. The array may include as many elements as are needed in order to provide the required bandwidth.

As discussed above, the phase relationships among the signals fed to the various dipole elements is such that the array is a broadside-firing array. It can be shown that to obtain a broadside-firing array, the power divider, e.g., as in FIG. 1(*c*), may be arranged to distribute signals that are substantially in phase with each other to the various dipole elements. One way in which this may be done is by feeding substantially the same signal to each dipole element. That is, the power divider may have equal impedances on its various branches. An example of this is discussed in the experimental results below.

Figure 3:
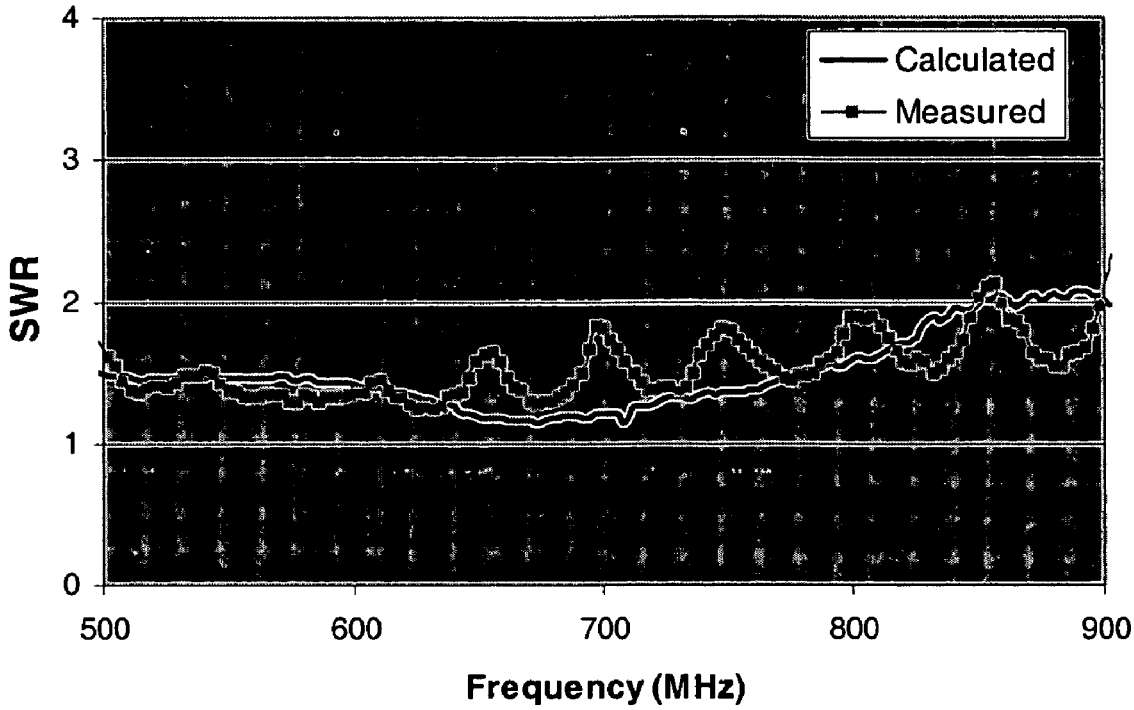
FIG. 3 is a graph showing calculated and measured SWR for the ICDA array of FIG. 1.

Experimental results Commercial tunable dipole antennas SNA600 were used, with center frequencies ranging from 550 MHz to 800 MHz and a bandwidth of 100 MHz each. Using the ratio values from the simulations, the center-frequencies of element 1 and element 2 were 610 MHz and 750 MHz, respectively. The lateral distance between the elements was 7.5 cm. Each element was connected to a Hewlett Packard 8510 network analyzer through a 3-dB power divider. Two pairs of such elements were placed in an anechoic chamber 5 m apart, one serving as a transmitter and the other as a receiver. The two arrays were facing each other, parallel to the radiation phase front. The power divider has a 50/3 ohm resistor on each port. The input impedance of the ICDA could be calculated as follows:

$$Z_{in} = \frac{(Z_{in,610} + 50/3)\cdot(Z_{in,750} + 50/3)}{Z_{in,610} + 50/3\cdot Z_{in,750} + 50/3} + \frac{50}{3},$$

where, $Z_{in,610}$ was the input impedance of 610-MHz element, $Z_{in,750}$ was the input impedance of 750-MHz element. FIG. 3 shows the calculated and measured SWR of the ICDA. It can be seen that the measured SWR and the calculated SWR are within the estimated error. This result confirms the conclusion that mutual couplings do not have a critical impact on the SWR.

Figure 4:
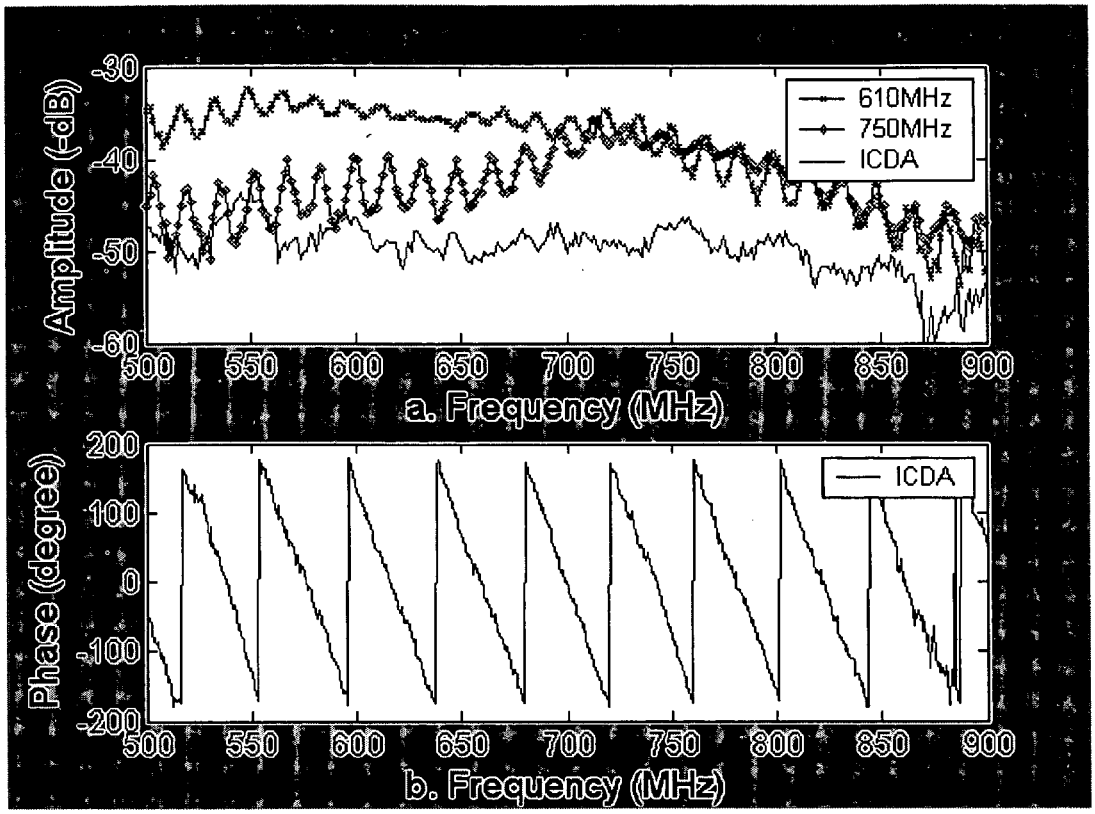
FIGS. 4(*a*) and 4(*b*) are graphs depicting transmission coefficients for the ICDA array.
Figure 5:
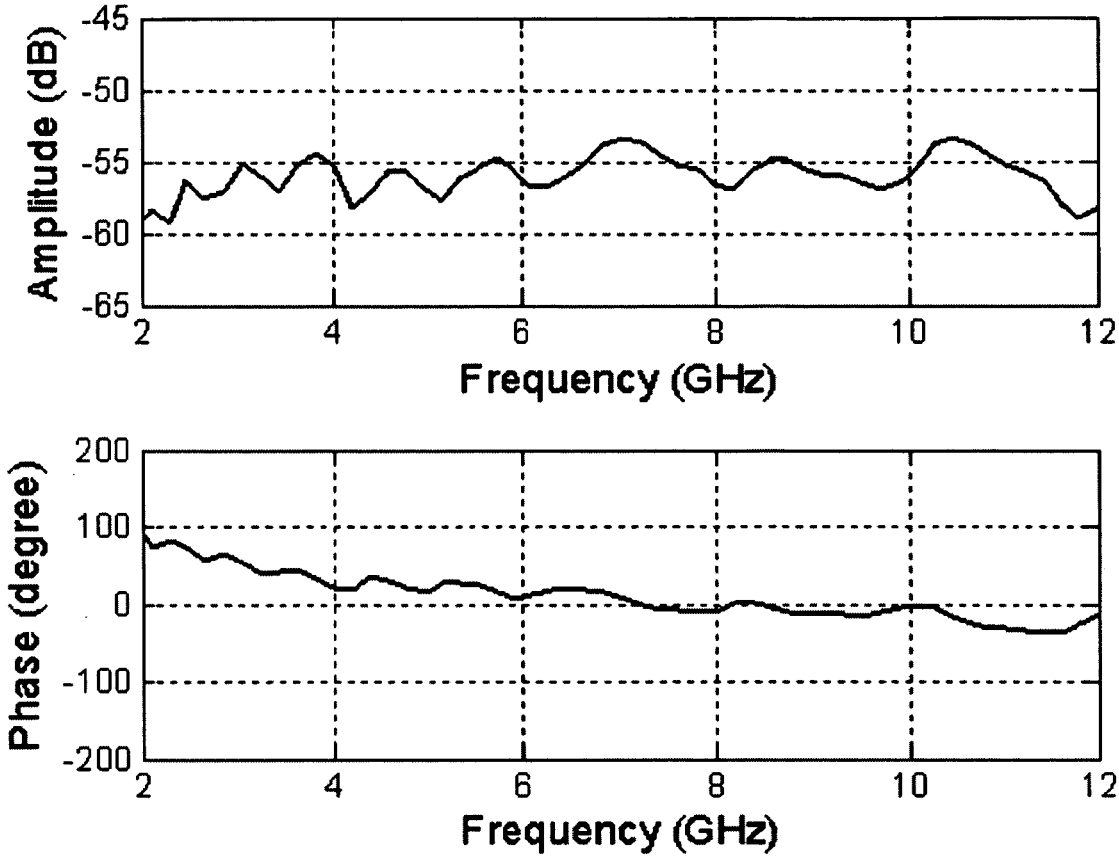
FIG. 5 presents the calculated transmission coefficient (amplitude and phase) for twelve elements as in FIG. 1(*b*).

FIG. 4(*a*) shows the $S_{21}$ amplitude characteristic of isolated elements 1 and 2. Element 1 had a 3-dB range between 560-MHz to 660-MHz. Element 2 had a 3-dB range between 700-MHz to 800-MHz with the exception of a few points where the amplitude fluctuated at 4-dB level. The $S_{21}$ amplitude characteristic and phase characteristic of the ICDA are shown in FIG. 4(*a*) and FIG. 4(*b*), respectively. It can be seen from FIG. 4(*a*) that in the range between 560-MHz to 800-MHz the amplitude characteristics do not fluctuate beyond the fluctuation of an individual element. Also, as shown in FIG. 4(*b*) the phase characteristics are linear in the entire range of 560-MHz to 800-MHz. FIG. 5 shows theoretical calculations for a twelve element antenna using FDTD method. These calculations demonstrate that such antenna meets the FCC bandwidth allocation for UWB systems in the range of 3.1-10.6 GHz.

In the foregoing the characteristics of the ICDA array are thus analyzed numerically and demonstrated experimentally. The simulations show that the mutual coupling does not significantly impact the SWR of each dipole. This is confirmed by the experimental data. The $S_{21}$ amplitude characteristic of the ICDA doesn't fluctuate beyond the individual element's fluctuation. Also, the phase characteristic is linear in the whole range of individual elements. The data indicates that this concept may be expanded to a larger number of dipolar elements to enable realization of a linear-phase antenna for UWB communication systems.

While the present invention has been described in terms of specific embodiments thereof, it will be understood in view of the present disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

What is claimed is:

1. A communication system comprising:

an ultra wide band (UWB) communication system; and an antenna array system to be coupled to said UWB communication system, the antenna array system comprising a number of dipole elements selected to provide a required bandwidth, said number being at least two, and means for feeding the dipole elements in parallel, each element to be fed individually, through a central point, with a desired transmission signal, said means for feeding the dipole elements in parallel comprising a power divider including a number of output branches equal to said number of dipole elements, each output branch comprising a substantially identical impedance, wherein the power divider is arranged such that a signal feeding any one of said number of dipole elements is substantially in-phase with a signal feeding any other of said number of dipole elements, and wherein the antenna array system is broadside firing and is made of a linear set with a functional relationship between the separation of elements and their related lengths and thicknesses.

2. A communication system in accordance with claim 1, wherein the means for feeding said dipole elements further comprises:

means to feed a broadband signal to said power divider.

3. A communication system in accordance with claim 2, further including a transmission line to be connected to said power divider to feed said broadband signal to said power divider to ensure feeding with appropriate amplitude and phase correction into the dipole elements.

4. A communication system in accordance with claim 1, wherein the antenna array is a log-periodic antenna array.

5. A communication system in accordance with claim 1, wherein frequency components of the desired transmission signal are to be radiated simultaneously by dipole elements corresponding to the frequency components.

6. A communication system in accordance with claim 1, wherein all frequency components of the desired transmission signal are to be received simultaneously by dipole elements corresponding to the frequency components.

7. An antenna array system for use as an Ultra Short Pulse transmitter and receiver for ultra wide band (UWB) communications which displays a substantially reduced dispersion, comprising:

at least a pair of dipole elements; and means for feeding said elements in parallel, each element individually, through a central point, with a transmission signal that is substantially identical in phase to a transmission signal that is fed to any other element, said means for feeding comprising a power divider having branches to be coupled to said dipole elements, wherein each branch comprises an impedance that is substantially identical to an impedance of any other branch, and wherein the dipole array is broadside firing and is made of a linear set with a functional relationship between the separation of elements and their related lengths and thicknesses.

8. An antenna array system in accordance with claim 7, wherein the means for feeding said elements comprises means to feed a broadband signal to said power divider.

9. An antenna array system in accordance with claim 8, further including a transmission line to be connected to said power divider to feed said broadband signal to said power divider to ensure feeding with appropriate amplitude and phase correction into the dipole elements.

10. An antenna array system in accordance with claim 7, wherein the dipole array is a log periodic array.

11. An antenna array system in accordance with claim 7, wherein the number of dipole elements in said array is greater than two.

12. An antenna array system in accordance with claim 7, wherein frequency components of the transmission signal are to be radiated simultaneously by dipole elements corresponding to the frequency components.

13. An antenna array system in accordance with claim 7, wherein all frequency components of the transmission signal are to be received simultaneously by dipole elements corresponding to the frequency components.

* * * * *